US005644328A

United States Patent [19]

Rhyne et al.

[11] Patent Number: 5,644,328

[45] Date of Patent: Jul. 1, 1997

[54] APPARATUS AND METHOD FOR OPERATING GROUPS OF LED DISPLAY PIXELS IN PARALLEL TO MAXIMIZE ACTIVE TIME

[75] Inventors: George W. Rhyne, Scottsdale; Paige M. Holm, Phoenix, both of Ariz.

[73] Assignee: Motorola, Schaumburg, Ill.

[21] Appl. No.: 398,270

[22] Filed: Mar. 3, 1995

[51] Int. Cl.[6] ..... G09G 3/32

[52] U.S. Cl. ..... 345/82; 345/214; 345/204

[58] Field of Search ..... 345/82–83, 55, 345/204, 211, 77, 214; 359/298, 58; 463/22

[56] References Cited

U.S. PATENT DOCUMENTS

| | | | |
|---|---|---|---|
| 4,260,159 | 4/1981 | Hoffman | 463/22 |
| 4,887,074 | 12/1989 | Simon et al. | 345/82 |
| 5,028,915 | 7/1991 | Yang | 345/82 |
| 5,063,462 | 11/1991 | Nakagawa et al. | 359/298 |
| 5,064,275 | 11/1991 | Tsunoda et al. | 359/58 |
| 5,138,310 | 8/1992 | Hirane et al. | 345/82 |
| 5,177,405 | 1/1993 | Kusuda et al. | 345/82 |
| 5,402,143 | 3/1995 | Ge et al. | 345/102 |
| 5,426,446 | 6/1995 | Takei et al. | 345/82 |

*Primary Examiner*—Mark R. Powell
*Assistant Examiner*—Martin Loui
*Attorney, Agent, or Firm*—Eugene A. Parsons

[57] ABSTRACT

A display (10) has pixels organized into groups (11, 41) that operate in parallel. Each group (11, 41) distributes the frame time (25) of the display over the number of active pixels within the group thereby maximizing the amount of time each pixel to be illuminated can be active.

12 Claims, 5 Drawing Sheets

APPARATUS AND METHOD FOR OPERATING GROUPS OF LED DISPLAY PIXELS IN PARALLEL TO MAXIMIZE ACTIVE TIME

Background of the Invention

The present invention relates, in general, to display devices, and more particularly, to a novel control scheme for operating a display.

Matrix addressing techniques are well known in the art and have been utilized to control various types of displays such as light emitting diode (LED) displays, and field emission device (FED) displays. Matrix addressing schemes typically organize the light emitting elements or pixels into a number of rows and columns with each pixel at an intersection of a particular row and a particular column. Illuminating the pixel requires activating an intersecting row and column thereby providing a closed current path that includes the pixel to be illuminated.

As the resolution of displays increase, the number of pixels in each row and column also increases and the amount of time available to illuminate each pixel decreases. As the illumination time decreases, each pixel must be driven with a larger current to provide a pixel intensity that maintains acceptable image intensity and viewing characteristics. Driving the pixel with a larger current generally results in reducing the useful lifetime of the pixel thereby limiting the useful lifetime of the display.

Accordingly, it is desirable to have a display control scheme that increases the active time for each pixel, and that increases the lifetime for each pixel.

DETAILED DESCRIPTION OF THE DRAWINGS

Figure 1:
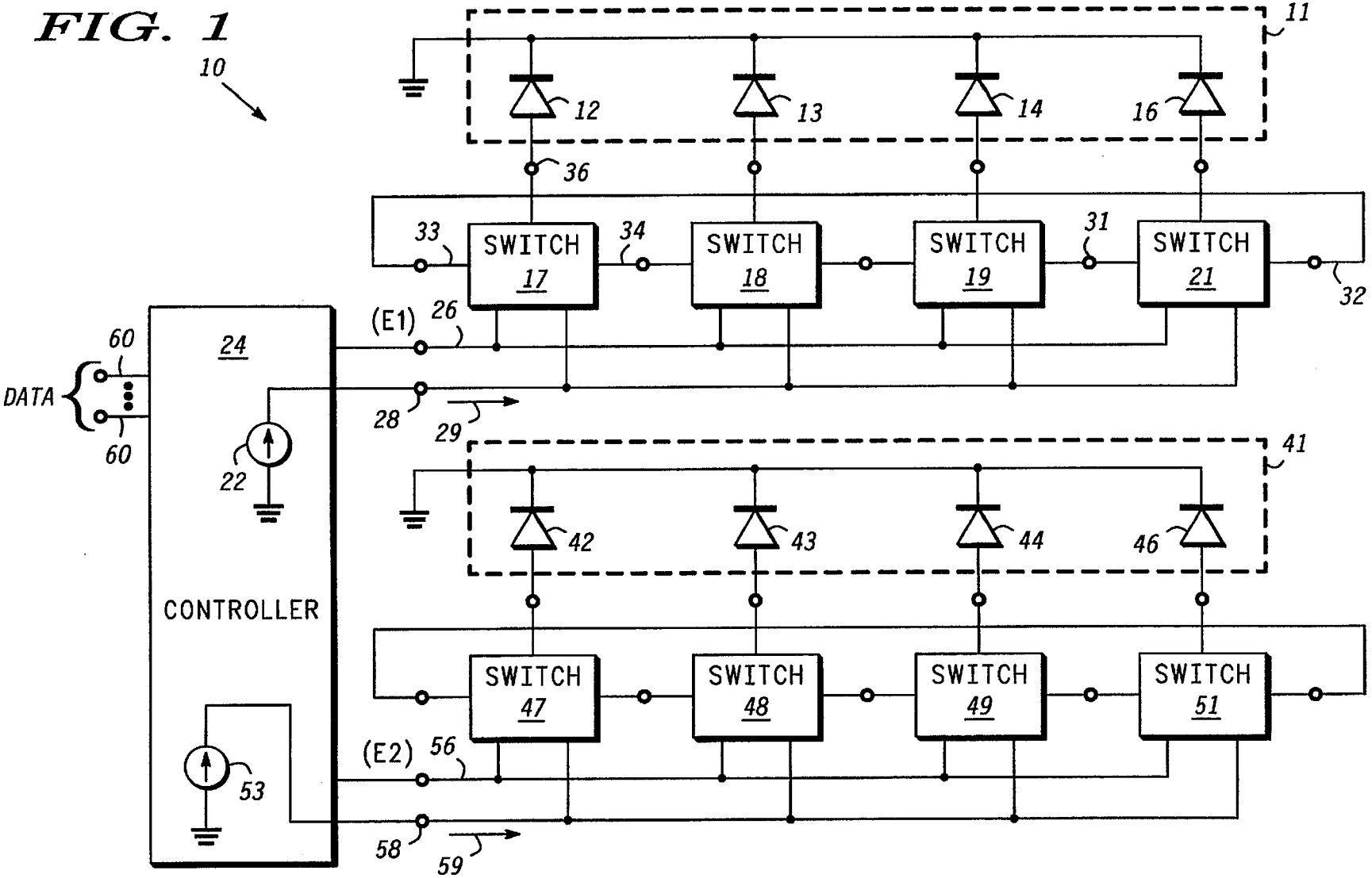
FIG. 1 schematically illustrates a display in accordance with the present invention.

FIG. 1 schematically illustrates a light emitting diode (LED) display 10. Display 10 includes a first plurality of LEDs including a first LED 12, a second LED 13, a third LED 14, and a fourth LED 16 that are organized together into a first group 11, illustrated by a dashed box. A second plurality of pixels includes a fifth LED 42, a sixth LED 43, a seventh LED 44, and an eighth LED 46 that are organized into a second group 41, illustrated by a dashed box. The cathode of LEDs 12, 13, 14, and 16 are each connected to ground, and an anode of LEDs 12, 13, 14, and 16 are connected to an output of a first switch 17, a second switch 18, a third switch 19, and a fourth switch 21, respectively. Similarly, the cathode of LEDs 42, 43, 44, and 46 are each connected to ground, and an anode of LEDs 42, 43, 44, and 46 are connected to an output of a first switch 47, a second switch 48, a third switch 49, and a fourth switch 51, respectively. Each switch and LED, for example LED 12 and switch 17, form a pixel of display 10. Groups 11 and 41 generally are organized as the pixels within a single display line or row of a display, although groups 11 and 41 could be organized as a vertical display line or column of a display or any other organization of display elements of a display. Although only two groups are illustrated, a display can have any number of groups and any number of LEDs in a group.

As will be seen hereinafter, a controller 24 operates group 11 and group 41 in parallel and utilizes the entire frame time of display 10 for displaying the information for group 11 and also the entire frame time to display the information for group 41. In operating group 11, the frame time is apportioned between the LEDs of group 11 that are to be illuminated, and LEDs that do not have data to be displayed are not illuminated. Each LED that is to be illuminated within group 11 is sequentially illuminated so that only one LED within group 11 is illuminated at a time, however, group 11 and 41 are operating in parallel so that more than one LED of display 10 can be illuminated simultaneously. Because the entire frame time is apportioned between the LEDs that are to be illuminated in group 11, the amount of time utilized to illuminate a particular LED is increased. Group 41 is operated in a similar manner in parallel with group 11.

Controller 24 receives informational data 60, for example 8-bit parallel data, to be displayed by display 10, stores the data, partitions and decodes the data into individual pixel data, and uses the individual pixel data to operate groups 11 and 41. The organization of controller 24 and the partitioning of data is further explained in the discussion of FIG. 3. In response to informational data 60, controller 24 develops a first enable signal (El) 26 that is connected to an enable input of switches 17, 18, 19, and 21 in order to control or enable the illumination of LEDs 12, 13, 14, and 16. Controller 24 also has a first current control output 28 that is connected to a current input of switches 17, 18, 19, and 21 in order to supply a first variable drive current 29 to LEDs 12, 13, 14, and 16, respectively. Drive current 29 is developed as the output of a variable current source 22 that is a part of controller 24. Controller 24 controls the amount of drive current 29 supplied by source 22. Controller 24 also has a second variable current source 53 that functions similarly to source 22. Source 53 has a second current output 58 that provides a second variable drive current 59 for switches 47, 48, 49, and 51 similarly to drive current 29.

The length of time an LED within a group is illuminated is referred to as the active time for the group and the LEDs within the group. The active time for each group varies depending on the data to be displayed by the group. The active time is determined by Equation 1 below:

$$AT=(\text{Frame Time}-(MDT*NNI))/NIL$$

where

AT=the active time for the group,

MDT=Minimum Display Time+minimum clock time (the minimum display time and minimum clock time are explained hereinafter in the discussion of FIG. 3), NNI=Number Not Illuminated i.e. number of LEDs within a group not having data to be displayed, thus, not illuminated, and NIL=Number Illuminate in the group.

As shown by the equation, the active time for a group where four LEDs are illuminated is less than the active time of a group having three LEDs that are illuminated. It should be noted that the above active time (AT) equation assumes a linear relationship among all the LEDs for the luminance verses drive current of the LED. Typically, the drive current is derived to provide an image intensity that is approximately the same as the intensity provided from driving the pixels with the maximum allowable drive current as shown by Equation 2 below:

$$ID=(I_{max}*T_{min})/AT$$

where

ID=the drive current(such as current 29 or 59), $I_{max}$=current that provides maximum pixel illumination intensity, $T_{min}$=time that $I_{max}$ is applied to provide the maximum illumination intensity, and AT=the active time.

Additionally, drive currents 29 and 59 can be varied to provide gray scale illumination for each pixel. Typically, controller 24 would receive the gray scale illumination information as a portion of data 60 and would adjust currents 29 and 59 in response to the gray scale information.

Figure 2:
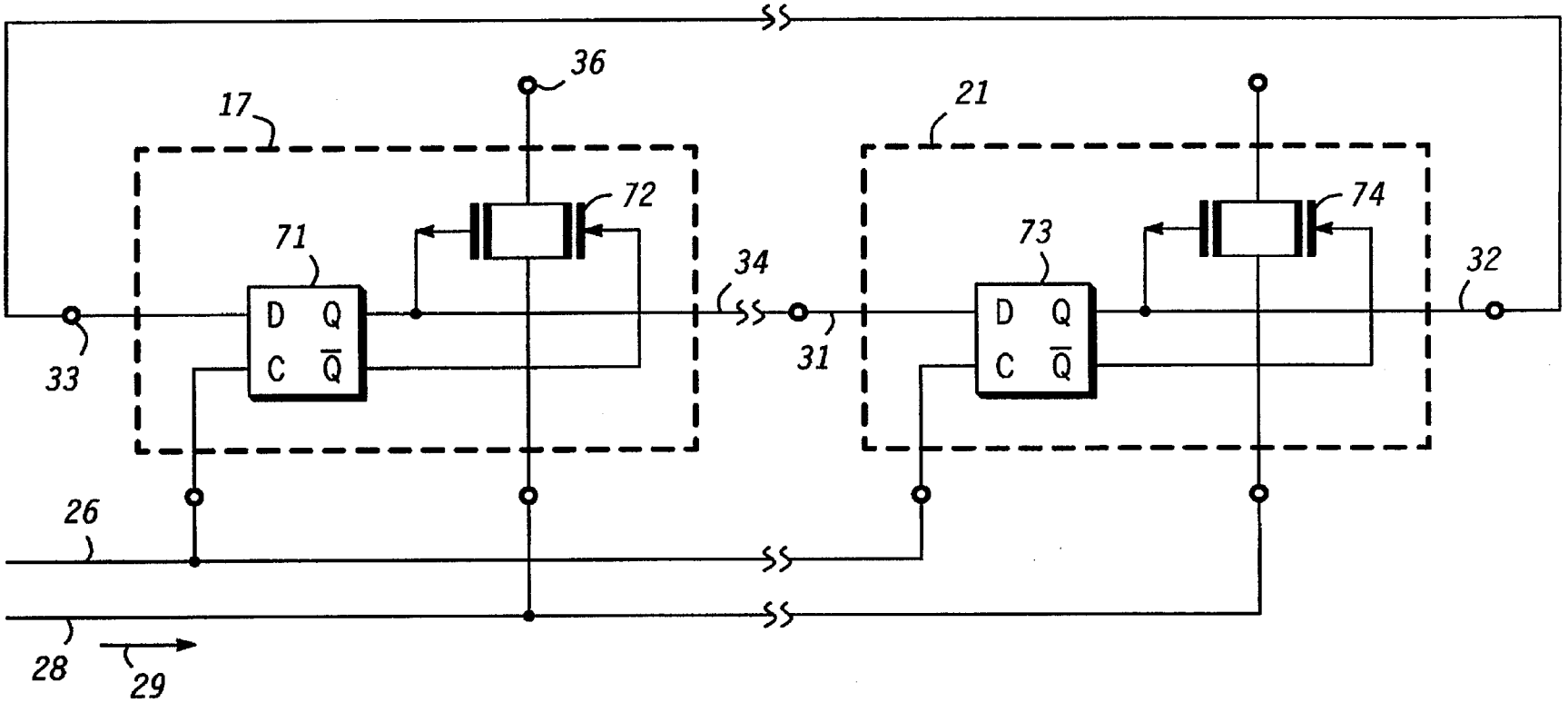
FIG. 2 schematically illustrates a portion of the display of FIG. 1 in accordance with the present invention.

FIG. 2 schematically illustrates an implementation suitable for switches 17, 18, 19, 21, 47, 48, 49, and 51 that are shown in FIG. 1. Elements of FIG. 2 that have the same reference numerals as FIG. 1 are the same as the corresponding FIG. 1 elements. Switches 17, 18, 19, and 21 (FIG. 1) have serial connections that facilitate forming a recirculating loop of a recirculating one in a field of zero's that is clocked from switch to switch by enable signal 26, and is utilized to sequentially enable each of LEDs 12, 13, 14, and 16 (FIG. 1). The technique of using a recirculating one in a field of zero's is well known to those skilled in the art. Each of switches 17, 18, 19, and 21 (FIG. 1) have a serial input that is connected to a serial output of a subsequent switch. For example, switch 21 has a serial input 31 that is connected to a serial output of switch 19, and a serial output 32 that is connected to a serial input 33 of switch 17. Switch 17 has a serial output 34 that is connected to a serial input of switch 18.

Switch 17 has a storage element that is used to provide the recirculating one in a field of zeros that is used to sequentially couple output 28 to LED 12. In the preferred embodiment the storage element is a flip-flop 71 having a clock input connected to signal 26 and a shift input connected to input 33 of switch 17 so that output 32 of switch 21 may be shifted into switch 17. Outputs Q and $\overline{Q}$ of flip-flop 71 are connected to a transmission gate 72 in order to couple current 29 from output 28 to output 36 of switch 17 thereby applying current 29 to LED 12. Similarly, switch 21 has a flip-flop 73 that functions similarly to flip-flop 71, and a transmission gate 74 that functions similarly to transmission gate 72.

Figure 3:
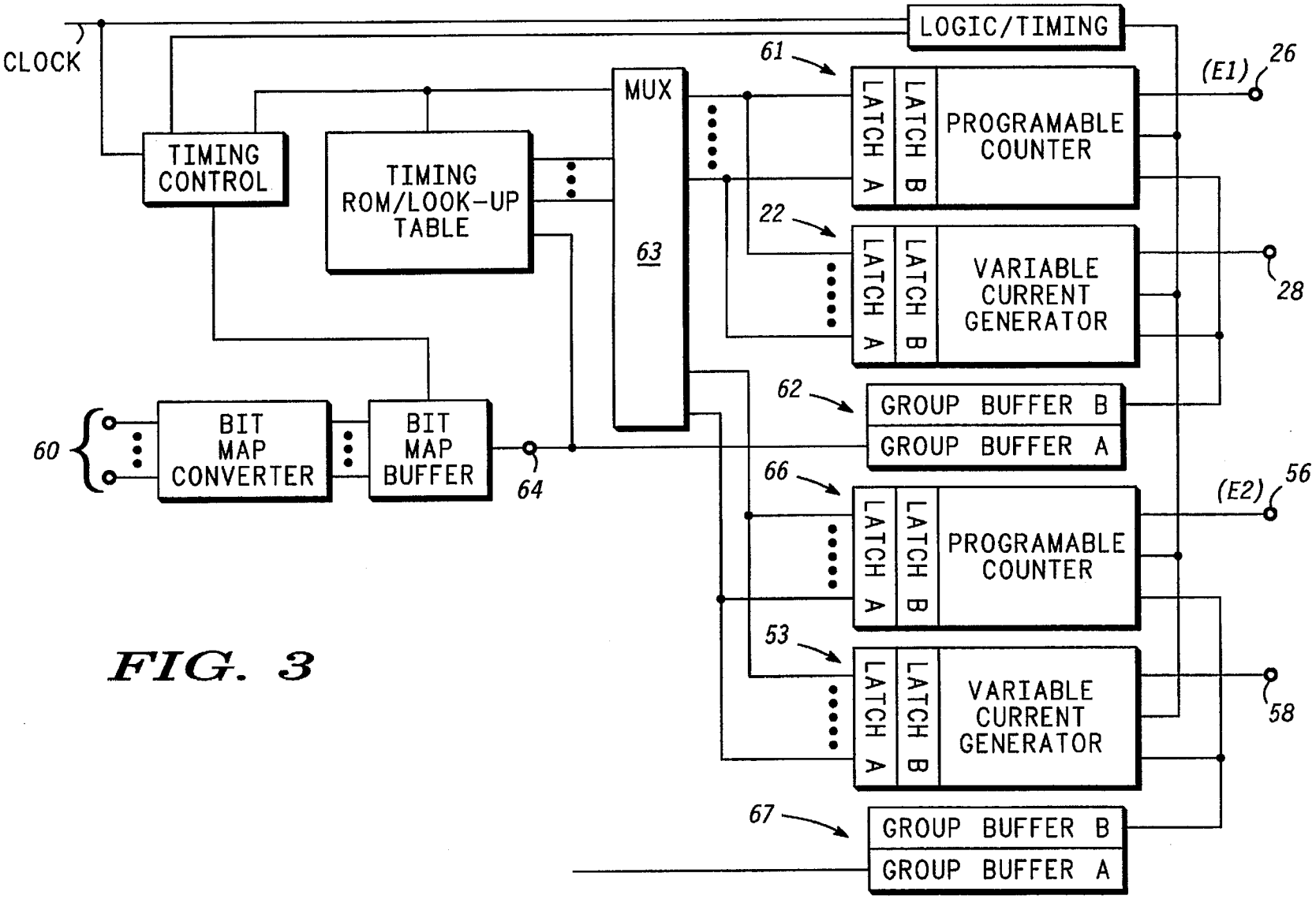
FIG. 3 schematically illustrates another portion of the display of FIG. 1 in accordance with the present invention.
Figure 4:
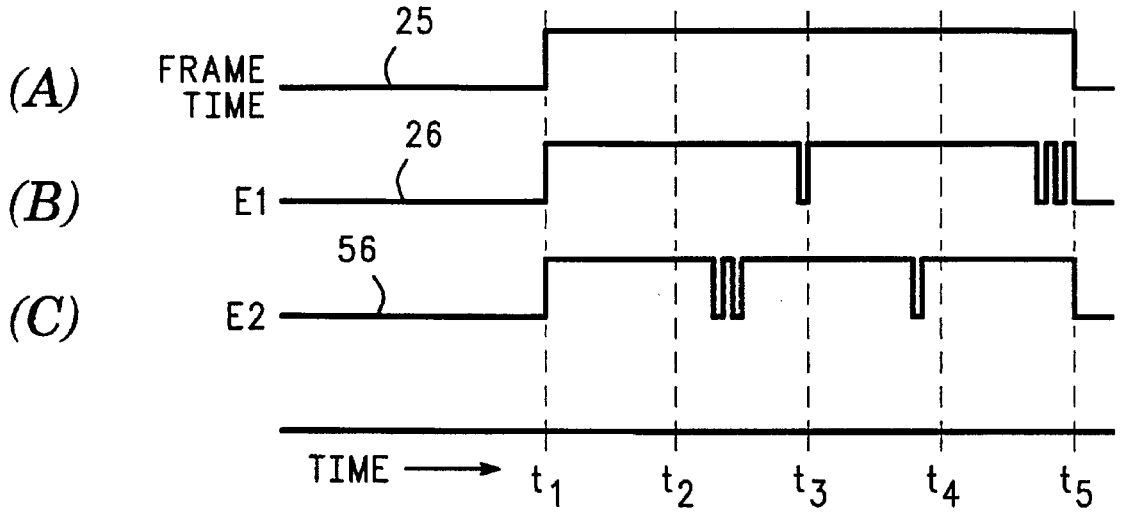
FIG. 4 is a timing diagram illustrating the operation of a portion of the display in FIG. 1 in accordance with the present invention.

FIG. 3 schematically illustrates a block diagram implementation that is suitable for controller 24 shown in FIG. 1. Elements of FIG. 3 that have the same reference numbers as FIG. 1 are the same elements as the corresponding FIG. 1 elements. Controller 24 can be implemented in a variety of ways. The block diagram shown in FIG. 3 is an example of one implementation method. Data 60 is presented to controller 24 where a Bit Map Converter converts the data to a bit mapped representation of the image to be displayed, then stores the converted information in a Bit Map Buffer. Bit map converters and buffers are well known in the art. A timing and control section receives a clock signal and controls the bit map buffer to provide bit mapped data 64 for a particular group, e.g. group 11, to a Timing ROM/Look-up Table that generates a timing sequence that follows the equation given in FIG. 1 for the bit mapped information for the group. For group 11, the timing sequence is stored, via a multiplexer 63, into a latch A of a sequencer or programmable counter 61, and into a latch A of variable current source 22. Also, bit mapped data 64 for group 11 is stored in a group buffer A of a group buffer 62. Controller 24 uses two group buffers (buffer A and buffer B) and two latches (latch A and latch B) for each of counter 61 and source 22 to facilitate storing information for a subsequent frame while information for the current frame is being displayed. This enables the bit mapped buffer and timing and control to develop timing and control sequences for one frame while a current frame is displayed. A Logic/Timing section receives the clock and an output of the Timing and Control section to facilitate controlling the operation of counter 61 and source 22 as shown in FIG. 4. Similarly, bit map data 64 for group 41 is provided to group buffer A of a group buffer 67, and to the Timing ROM/Look-up Table then to a latch A of a programmable counter 66 and to a latch A of variable current source 53.

FIG. 4 is a timing diagram illustrating an example of the operation of enable signals 26 and 56 that are shown in FIG. 1 and FIG. 3. Portions of FIG. 4 that have the same reference numerals as FIG. 1 are the same as the corresponding FIG. 1 elements. The abscissa of FIG. 4 represents time and is divided into four equal time slots indicated by time points $t_1$, $t_2$, $t_3$, $t_4$, and $t_5$. Time points $t_1$–$t_5$ represent the points where LEDs would switch if all four LEDs in a group were to be illuminated. A frame time signal 25 is used as a reference to illustrate the time in which data is to be displayed by display 10 of FIG. 1. Frame time signal 25 becomes active at time $t_1$ when display 10 can display information.

The example shown in FIG. 4 illustrates timing for group 11 when LEDs 12 and 13 are to be illuminated and LEDs 14 and 16 do not have data and are not to be illuminated. FIG. 4 also illustrates timing for group 41 when LEDs 42, 44, and 46 are to be illuminated and LED 43 does not have data and is not to be illuminated. Consequently, controller 24 utilizes the equation shown in the discussion of FIG. 1 to determine a first active time for group 11 and a separate second active time for group 41. Additionally, controller 24 sets output current 29 to a value that will provide a maximum illumination intensity or desired illumination intensity for LEDs 12 and 13 during the first active time, and sets output current 59 to a value that will provide the desired illumination intensity for LEDs 42, 44, and 46 during the second active time. For a monochrome image, the desired illumination intensity typically is equivalent to a maximum illumination intensity for the LED, that is, equivalent to the illumination intensity provided by the maximum current of the LED for a pixel time of a normal raster scan CRT display. For a gray scale image, the desired illumination intensity can be less in order to provide the lower intensity gray scale images. Because display 10 utilizes the entire frame time for each group 11 and 41, currents 29 and 59, respectively, are less than the maximum current of the LED, yet the desired intensity can equal the equivalent maximum LED intensity.

Because LEDs 14 and 16 do not have data to be displayed, LEDs 14 and 16 are not to be illuminated. However, the recirculating one must still be clocked through switches 19 and 21. Therefore, enable signal 26 must have transitions to create a clock signal for the flip-flop storage elements of switches 19 and 21. These transitions are created by taking signal 26 low for a minimum clock time that is just sufficient for a clock set-up time for the flip-flop, and then taking signal 26 high for a minimum display time to create a transition that clocks data into the flip-flop. The minimum display time is just sufficient to clock data into the flip-flop. During this minimum display time, source 22 typically is disabled to prevent current 29 from creating an image during the minimum display time. Alternately, current 29 can be coupled to drive the corresponding LED, but since the time that signal 26 remains high is limited, the short time prevents creating an observable image on display 10 (FIG. 1).

For this example, controller 24 calculates the first active time using the equation shown in the discussion of FIG. 1 to allocate the frame time among the two LEDs 12, and 13 and a minimum display time that is allocated to LEDs 14 and 16. Signal 26 ($E_1$) becomes active at time $t_1$ when signal 25 becomes active. Since the recirculating one is stored in switch 21, this causes switch 17 to clock the recirculating one on output 32 of switch 21 into switch 17 thereby enabling switch 17 to apply current 29 to LED 12. Signal 26 remains high for the first active time (past time point $t_2$), goes low for a minimum clock time then goes high prior to time $t_3$ to clock the recirculating one on output 34 of switch 17 into switch 18 thereby enabling switch 18 to apply current 29 to LED 13. Signal 26 remains high for the first active time so that LED 13 is illuminated for a time equal to the time LED 12 was illuminated, and then goes low for a minimum clock time, goes high for a minimum display time to clock the output of switch 18 into switch 19 thereby enabling LED 14 to apply current 29 to LED 14 for the minimum display time, goes low for a minimum clock time, and goes high for a minimum display time again to clock the output of switch 19 into switch 21 thereby disabling switch 19 and enabling switch 21 to apply current 29 to LED 16 for the minimum display time. Thereafter, signal 25 goes low to indicate the end of the frame time, thus, signal 26 goes low and controller 24 disables current source 22 thereby preventing the illumination of group 11.

Similarly, signal 56 ($E_2$) is used to illuminate LEDs 42, 44, and 46 of group 41. For this example, controller 24 calculates the second active time using the equation shown in the discussion of FIG. 1 to allocate the frame time among the three LEDs 42, 44, and 46 and a minimum display time that is allocated to LED 43. Signal 56 ($E_2$) becomes active at $t_1$ in parallel with signal 26 so that groups 11 and 41 are operating simultaneously. Signal 56 remains high for the second active time past $t_2$ but for a time less than the first active time because group 41 has three LEDs illuminated whereas group 11 only has two LEDs. Signal 56 then goes low for a minimum clock cycle and then back high for a minimum display time to clock the recirculating one from switch 47 into switch 48 thereby enabling LED 43 for the minimum display time, then back low for a minimum clock cycle and back high again to clock the recirculating one into switch 49 thereby enabling LED 44 for the second active time. While LED 43 is briefly enabled during the minimum display time, controller 24 can set current 59 to zero to prevent illuminating LED 43, or can leave current 59 unaffected since the time LED 43 is illuminated is so brief that an image will not be perceived by an individual observing display 10. Signal 56 remains high for the second active time for LED 44, and then goes low and back high again to clock the output of switch 49 into switch 51 thereby enabling switch 51 to apply current 59 to LED 46 for the second active time thereby illuminating LED 46 for the second active time. Thereafter, signal 25 goes low to indicate the end of the frame time, thus, signal 56 goes low and controller 24 (FIG. 1) disables current source 53 thereby preventing the illumination of group 41.

Figure 5:
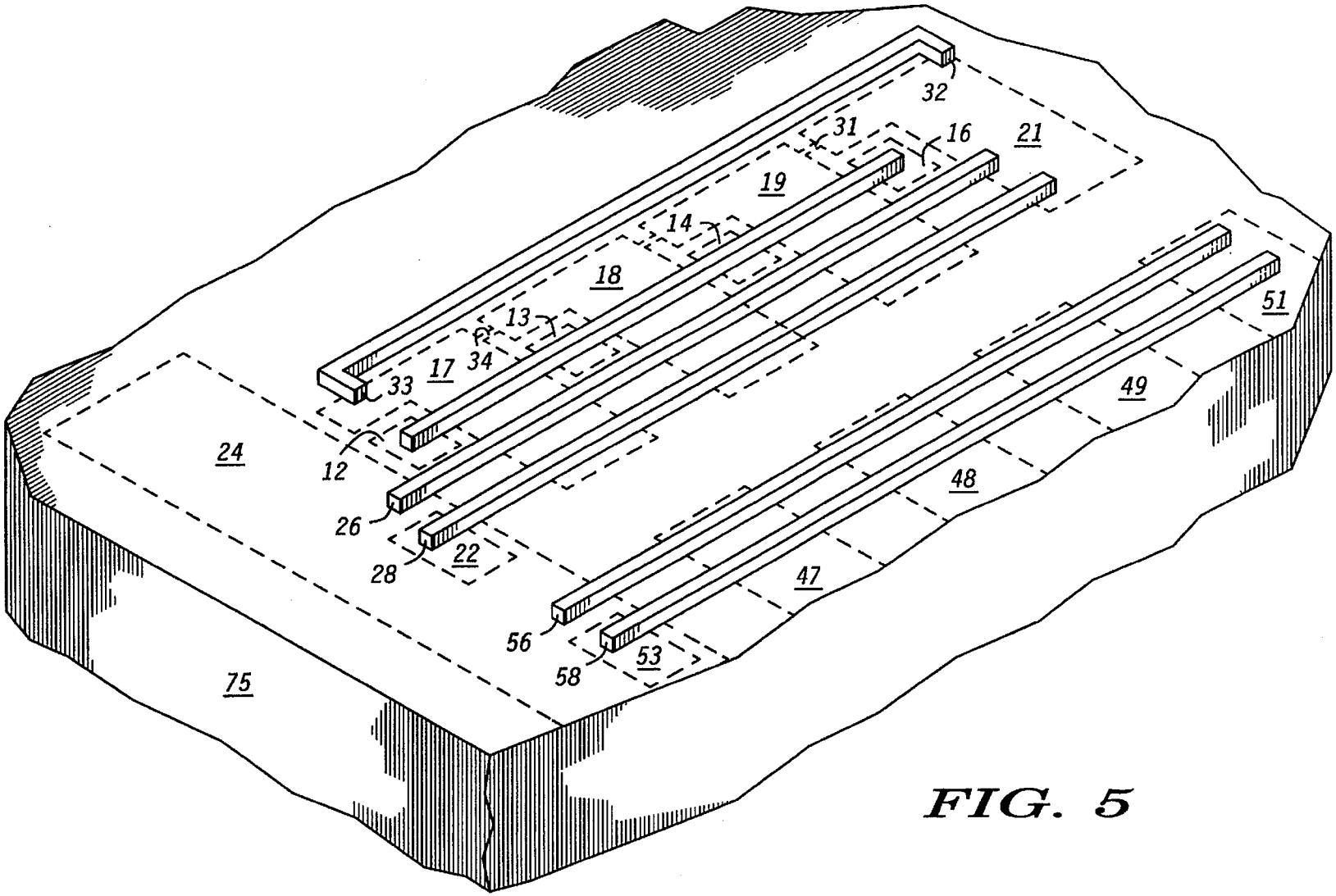
FIG. 5 illustrates a perspective cut-away portion of the display of FIG. 1 in accordance with the present invention.

FIG. 5 is a perspective view illustrating display 10 implemented as a monolithic semiconductor display on a semiconductor substrate 75. Elements of FIG. 5 that have the same reference numerals as FIG. 1 are the same as the corresponding FIG. 1 elements.

By now it should be appreciated that there has been provided a novel control scheme for a display device. By organizing the pixel elements into groups and operating all groups in parallel, the amount of time available to illuminate an individual pixel is increased.

Furthermore, by allocating the entire frame time to pixels that are to be illuminated within a group, the amount of time available for each pixel is further increased. Increasing the display time allows driving the pixel elements at a lower intensity thereby increasing the useful lifetime of each pixel element and the display.

We claim:

1. A method of controlling a display comprising the steps of:

organizing pixels of the display into a plurality of groups; and operating the plurality of groups in parallel and illuminating each pixel in a group of the plurality of groups for an active time, which is approximately equal to a frame time minus a first quantity equal to a number of nonilluminated pixels in the group multiplied by a second quantity equal to a minimum display time plus a minimum clock time all divided by a number of illuminated pixels in the group.

2. The method of claim 1 wherein operating the plurality of groups in parallel further includes using a variable drive current to illuminate the pixels.

3. The method of claim 2 wherein using the variable drive current further includes using a drive current value that provides a maximum illumination intensity for an active time of the pixels.

4. The method of claim 1 wherein operating the plurality of groups in parallel further includes operating the plurality of groups in parallel during a frame time of the display.

5. A method of controlling a display comprising the steps of:

organizing pixels of the display into a plurality of groups;

determining an active time for each group of the plurality of groups;

determining a drive current for each group of the plurality of groups; and operating each group of the plurality of groups in parallel for a frame time of the display by applying the drive current to the plurality of groups and illuminating each pixel to be displayed within a group for the active time of the group, the active time being approximately the frame time minus a first quantity equal to a number of non-illuminated pixels in the group multiplied by a second quantity equal to a minimum display time plus a minimum clock time all divided by a number of illuminated pixels in the group.

6. The method of claim 5 wherein determining the drive current for each group of the plurality of groups further includes multiplying a maximum illumination intensity current value for a pixel by a minimum display time and dividing the result by the active time.

7. A display comprising:

a first plurality of pixels organized as a first group of the display;

a first variable current source coupled to provide a first drive current to each pixel of the first plurality of pixels;

a second plurality of pixels organized as a second group of the display;

a second variable current source coupled to provide a second drive current to each pixel of the second plurality of pixels;

a controller for operating the first and the second plurality of pixels in parallel in response to data to be displayed by the first and second plurality of pixels, the controller having a first output that is a first enable signal coupled to each pixel of the first plurality of pixels to establish a first active time for each pixel of the first plurality of pixels, the first active time being approximately a frame time of the display minus a first quantity equal to a number of non-illuminated pixels of the first plurality of pixels multiplied by a second quantity equal to a minimum display time plus a minimum clock time all divided by a number of illuminated pixels of the first plurality of pixels; and a second enable signal that is a second output of the controller coupled to each pixel of the second plurality of pixels to establish a second active time for each pixel of the second plurality of pixels, the second active time being approximately the frame time of the display minus a third quantity equal to a number of non-illuminated pixels of the second plurality of pixels multiplied by a fourth quantity equal to the minimum display time plus the minimum clock time all divided by a number of illuminated pixels of the second plurality of pixels.

8. The display of claim 7 wherein each pixel of the first plurality of pixels includes a first switch that couples the first drive current to each pixel of the first plurality of pixels in response to the first enable signal, and wherein each pixel of the second plurality of pixels includes a second switch that couples the second drive current to each pixel of the second plurality of pixels in response to the second enable signal.

9. The display of claim 8 wherein each first switch includes a storage element for coupling the first drive current to the first plurality of pixels.

10. The display of claim 7 wherein the first drive current includes a maximum illumination intensity current value multiplied by a minimum active time divided by the first active time, and wherein the second drive current includes the illumination intensity current value multiplied by the minimum active time divided by the second active time.

11. The display of claim 7 wherein the controller includes a sequencer that sequentially enables each pixel of the first plurality of pixels.

12. The display of claim 7 further including forming the first plurality of pixels, the first variable current source, the second plurality of pixels, the second variable current source, and the controller on a semiconductor substrate.

* * * * *